United States Patent [19]

Wakita et al.

[11] 4,363,660

[45] Dec. 14, 1982

[54] IRON-BASE ALLOY HAVING HIGH RESISTANCE TO MOLTEN ZINC ATTACK

[75] Inventors: Saburo Wakita, Ohmiya; Akihiko Sakonooka, Ageo, both of Japan

[73] Assignee: Mitsubishi Kinzoku Kabushiki Kaisha, Tokyo, Japan

[21] Appl. No.: 217,015

[22] PCT Filed: Apr. 4, 1980

[86] PCT No.: PCT/JP80/00060

§ 371 Date: Nov. 26, 1980

§ 102(e) Date: Nov. 26, 1980

[87] PCT Pub. No.: WO80/02161

PCT Pub. Date: Oct. 16, 1980

[30] Foreign Application Priority Data

Apr. 4, 1979 [JP] Japan ..... 54-40616

[51] Int. Cl.[3] ..... C22C 38/40

[52] U.S. Cl. ..... 75/128 B; 75/128 A; 75/128 C; 75/128 D; 75/128 G; 75/128 W; 75/128 Z; 420/585

[58] Field of Search ..... 75/128 A, 128 B, 128 C, 75/128 D, 128 G, 128 Z, 128 W, 134 F

[56] References Cited

U.S. PATENT DOCUMENTS

| | | | |
|---|---|---|---|
| 2,801,916 | 8/1957 | Harris et al. | 75/128 W |
| 3,282,687 | 11/1966 | Cape | 75/128 B |
| 3,488,186 | 1/1970 | Decker et al. | 75/128 B |
| 3,834,901 | 9/1974 | Kamiya et al. | 75/128 B |
| 4,272,289 | 6/1981 | Herchenroeder et al. | 75/128 B |

FOREIGN PATENT DOCUMENTS

| | | |
|---|---|---|
| 47-44857 | 11/1972 | Japan . |
| 55-2711 | 1/1980 | Japan . |

*Primary Examiner*—John P. Sheehan

*Attorney, Agent, or Firm*—Oblon, Fisher, Spivak, McClelland & Maier

[57] ABSTRACT

An iron-base alloy having high erosion resistance to molten zinc attack which essentially consists of (by weight):

0.01 to 2% of carbon;

0.01 to 2% of silicon;

0.01 to 2% of manganese;

totally 1 to 6% of at least one element selected from the group consisting of niobium and tantalum;

totally 1 to 10% of at least one element selected from the group consisting of molybdenum and tungsten;

10 to 30% of nickel;

10 to 30% of cobalt;

10 to 25% of chromium; and a balance which is iron and inevitable impurities.

4 Claims, 1 Drawing Figure

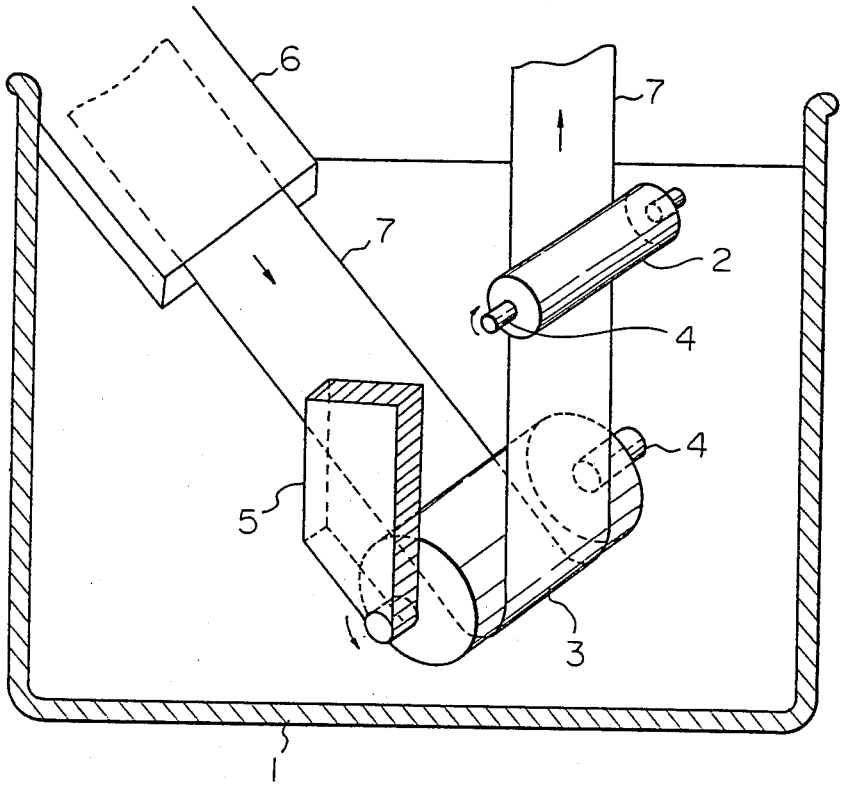
6
7
7
2
4
4
5
3
1

IRON-BASE ALLOY HAVING HIGH RESISTANCE TO MOLTEN ZINC ATTACK

TECHNICAL FIELD

This invention relates to an iron-base alloy having high resistance to molten zinc attack, and more particularly, to such an iron-base alloy that can be cast, worked or build-up welded as a structural member to be directly exposed to molten zinc, for example, a structural member of a continuous molten zinc plating apparatus.

The invention further relates to a structural member of a continuous molten zinc plating apparatus produced from such an iron-base alloy.

BACKGROUND ART

As schematically represented in FIG. 1, a continuous molten zinc plating apparatus comprises a plating bath (pot) 1, support roll 2, sink roll (pot roll) 3, sleeve 4, hanger (arm) 5 and a snout 6. In the apparatus shown in FIG. 1, a steel plate 7 supplied to the bath through the snout 6 is directed as shown by the arrow to the sink roll 3 supported by the hanger 5, and after being plated with a given amount of zinc, it is recovered from the bath 1 through the support roll 2. In the figure, the rolls rotate in the direction indicated by the arrow.

Conventionally, the structural members of the continuous molten zinc plating apparatus are produced by casting or plastic working of low-carbon steel or stainless steel (e.g. JIS SUS No. 304,309) or cast stainless steel (e.g. JIS HH). For example, cast stainless steel from which the support roll, sink roll, sleeve and bearing metal are produced is exposed to mechanical wear of fluid zinc and its resistance to molten zinc attack (hereunder referred to as erosion resistance) is so low that it must be replaced every one or two weeks. Therefore, researchers are making experiments on the build-up welding of Stellite alloy or plasma-spray coating of tungsten carbide (WC) on the surface of stainless steel.

Low-carbon steel of which the plating bath or snout is made has poor erosion resistance in molten zinc even when its degree of fluidity is relatively low. Therefore, the wall of the plating bath or snout is made of a thick plate or lined with a thin sheet of Hayne's alloy (e.g. HA-No. 25) generally considered to have relatively high erosion resistance in stationary zinc.

However, even the lined structural member does not present satisfactory erosion resistance when molten zinc is in a fluid state (e.g. the inside of the snout, or where the member is contacted by the topmost level of bath or in the vicinity thereof).

A support roll having good erosion resistance can be made of a structural member build-up welded with Stellite alloy since Stellite alloy has good mechnical wear resistance and exhibits relatively good erosion resistance in fluid zinc. On the other hand, Stellite alloy is so hard that the support roll may cause a steel plate being galvanized to develop a flaw and the support roll may develop a crack on the surface when it is being reground. Therefore, the structural member made by build-up welding with Stellite alloy cannot have a long useful life. Besides, as is typically found with Stellite No. 6 whose standard composition is Co: 61%, Cr: 28%, W: 5%, Ni: 1.5%, and others: 4.5% (by weight), Stellite alloys have a high content of expensive Co and this presents a high-cost problem.

DISCLOSURE OF INVENTION

Therefore, one object of this invention is to provide an iron-base alloy which is cheap, has good erosion resistance against fluid molten zinc, adequately withstands mechanical wear, has a hardness not great enough to damage a steel plate, and which can be used as a casting material, working material or a build-up welding material.

Another object is to provide a structural member made of such iron-base alloy which can be continuously used for a long period of time as the constituent material of a continuous molten zinc plating apparatus.

A further object of this invention is to provide a method of using such iron-base alloy to prevent the erosion of fluid molten zinc.

To achieve these objects, we have made various studies and experiments and have accomplished this invention.

According to our finding, Nb (and/or Ta), Mo (and/or W), Co and C are elements that reduce the erosion to molten zinc, whereas Ni, Cr, Al and Ti are elements that increase erosion. Therefore, an alloy having good erosion resistance must be free of Al and Ti, contain a minimum of Cr and Ni, and have an increased amount of Co and a maximum of Mo and Nb as an alloying element. Iron (Fe), when it forms an alloy with Co, Nb, Mo, etc., is essentially neutral in its effect on the erosion resistance, so it is considered economically desirable to use a suitable amount of Fe for providing a balance among the alloying elements.

Thus, this invention provides an iron-base alloy having high erosion resistance to molten zinc attack which essentially consists of (by weight): 0.01 to 2% of carbon, 0.01 to 2% of silicon, 0.01 to 2% of manganese, totally 1 to 6% of at least one element selected from the group consisting of niobium and tantalum, totally 1 to 10%, preferably 5.5 to 10%, of at least one element selected from the group consisting of molybdenum and tungsten, 10 to 30% of nickel, 10 to 30% of cobalt, 10 to 25% of chromium, with the balance being iron and inevitable impurities.

More preferably, such an iron-base alloy essentially contains 5.5 to 10% of molybdenum.

The iron-base alloy according to this invention may further contain at least one element selected from the group consisting of 0.001 to 2% of zirconium and 0.001 to 2% of boron. The preferred ranges of nickel, cobalt and chromium are as follows: 10 to 15% of nickel, 15 to 30% of cobalt, and 10 to 18% of chromium.

Thus, this invention is characterized by exclusion of Ti and Al which have the effect of reducing the erosion resistance of an alloy, and the iron-base alloy thus produced has good erosion resistance to molten zinc attack. Therefore, this invention also provides a structural member for use as the constituent material of a continuous molten zinc plating apparatus, said member being composed of an iron-base alloy which essentially consists of (by weight): 0.01 to 2% of carbon, 0.01 to 2% of silicon, 0.01 to 2% of manganese, totally 1 to 6% of at least one element selected from the group consisting of niobium and tantalum, totally 1 to 10%, preferably 5.5 to 10%, of at least one element selected from the group consisting of molybdenum and tungsten, 10 to 30% of nickel, 10 to 30% of cobalt, 10 to 25% of chromium, with the balance being iron and inevitable impurities.

We now describe the reasons for limiting the constituent elements to the defined ranges.

Carbon (C):

If the carbon content is less than 0.01%, the desired fluidity cannot be assured during casting and build-up welding. Besides, an alloy having the desired strength cannot be obtained. If the carbon content is more than 2%, the hardness of the alloy increases significantly and the resulting significant embrittlement causes the alloy to develop many cracks. Therefore, the carbon content is defined to be within the range of from 0.01 to 2%.

Silicon and manganese (Si and Mn):

Silicon and manganese have deoxidizing and desulfurizing activities. Silicon also has the effect of improving fluidity, and manganese has the effect of providing a tough alloy. If the Si and Mn contents, respectively, are less than 0.01%, their effects are not achieved. If the Si and Mn contents, respectively, are more than 2%, excess silicon provides a too brittle alloy, and excess manganese has no corresponding improvement effect. Therefore, the silicon and manganese contents, respectively, are defined to be within the range of from 0.01 to 2%.

Niobium and tantalum (Nb and Ta):

Nobium and tantalum have the effect of improving erosion resistance appreciably, but if their total content is less than 1%, such effect is not obtained, and if their total content is more than 6%, the resulting alloy has reduced castability and plastic workability. Therefore, the sum of the niobium and tantalum contents is defined to be within the range of from 1 to 6%. The alloy of this invention contains at least either niobium or tantalum.

Molybdenum and tungsten (Mo and W):

Molybdenum and tungsten have the effect of further improving erosion resistance in the presence of niobium or tantalum. If the total content of Mo and W is less than 1%, the intended effect is not obtained, and if the total content is more than 10%, corresponding improvement is not obtained and only unnecessarily high cost results. Therefore, the total content of molybdenum and tungsten is defined to be within the range of from 1 to 10%, preferably from 5.5 to 10%. More preferably, the alloy of this invention essentially contains 5.5 to 10% of Mo and improved erosion resistance is achieved by such high molybdenum content.

Nickel (Ni):

Nickel has the effect of improving the plastic workability of an alloy by austenitizing its structure. If the content of nickel is less than 10%, no improvement in plastic workability is achieved, and if the content is more than 30%, considerable reduction in erosion resistance results. Therefore, the nickel content is defined to be within the range of from 10 to 30%, more preferably from 10 to 15%.

Cobalt (Co):

Cobalt has the effect of further improving the high erosion resistance achieved by niobium, molybdenum and tungsten. Cobalt also has the effect of improving the plastic workability of an alloy by working with nickel to austenitize its structure. If the cobalt content is less than 10%, these effects are not ensured, and if the cobalt content is more than 30%, no further improvement is achieved and only unnecessarily high cost results. Therefore, the cobalt content is defined to be within the range of from 10 to 30%, preferably from 15 to 30%.

Chromium (Cr):

Chromium has the effect of not only strengthening the alloy matrix but providing improved resistance to oxidation. If the chromium content is less than 10%, such effect is not obtained, and if the content is more than 25%, considerable reduction in erosion resistance results. Therefore, the chromium content is defined to be within the range of from 10 to 25%, preferably from 10 to 18%.

Zirconium and boron (Zr and B):

Zirconium and boron have the effect of improving the erosion resistance of grain boundary in the presence of niobium, tantalum, molybdenum and tungsten. It also has the effect of providing tough grain boundaries that prevent cracking from occurring during plastic working. If the content of zirconium or boron is less than 0.001%, these effects are not obtained, and if each content is more than 2%, the resulting alloy is very brittle. Therefore, the content of each of zirconium and boron is defined to be within the range of from 0.001 to 2%.

According to this invention, Al and Ti are positively excluded.

The inevitable impurities included in the alloy of this invention are phosphor (P), sulfur (S), vanadium (V), oxygen (O), etc., and their content, respectively, is limited generally to 0.05% or less, usually to 0.01% or less.

BRIEF DESCRIPTION OF DRAWINGS:

The accompanying drawing is a schematic representation of the construction of a continuous molten zinc plating apparatus.

EXAMPLES

The alloy of this invention (hereunder the invention alloy) is not described by reference to the following examples wherein the invention alloy is compared with control alloys and prior art alloys.

Samples of molten metal having the final compositions indicated in Table 1 were prepared in a high-frequency furnace by the conventional atmospheric melting process, and the samples obtained were cast into sand molds to form invention alloys 1 to 20, control alloys 1 to 5 and prior art alloys 1 and 2 each measuring 100 mm long, 80 mm wide and 15 mm thick, as well as invention alloys 21 and 22 and prior art alloys 3 and 4 each measuring 75 mm across and 150 mm high. The invention alloys 21 and 22 and prior art alloys 3 and 4 were hot forged at 1100° C. to provide a diameter of 15 mm.

The all control alloys 1 to 5 had compositions outside the scope of this invention. Prior art alloys 1, 2, 3 and 4 had compositions that were equivalent to those of cast stainless steel HH, Stellite No. 6, low-carbon steel and Haynes' alloy No. 25.

Test pieces for erosion resistance test each measuring 12 mm across and 35 mm long were chipped from the invention alloys 1 to 22, control alloys 1 to 5 and prior art alloys 1 to 4. The pieces were immersed in molten zinc at 470° C. and 520° C. while they were rotated on a circle (radius 35 mm) at 230 r.p.m. After a 25-hrs retainment, the pieces were recovered and the average depth of erosion of each sample was measured. The measurements are also indicated in Table 1 and they assume retainment time of one year. In practical operation, the structural members of a molten zinc plating apparatus or the like are often exposed to direct contact with molten zinc in a fluid state, and some alloys have very low resistance to erosion of fluid molten zinc no matter how high their erosion resistance is in an immersion test with stationary molten zinc. It is therefore very important to evaluate the erosion resistance of alloys in an immersion test with fluid molten zinc as we did in the examples.

Table 1 also contains the measurements of the high-temperature hardness (Hv: 50 g) of the respective alloys at 500° C.

As described in the foregoing, the alloy of this invention has very high erosion resistance, so it can be cast, worked into or build-up welded onto a structural member for the plating bath, sleeve and snout of a continuous molten zinc plating apparatus. The alloy also has a

TABLE 1

| Alloy No. | Composition (wt %) C | Si | Mn | Nb | Ta | Mo | W | Ni | Co | Cr | Zr | B | Fe | av. depth of erosion (mm/year) 470° C. | 520° C. | Hardness 500° C. Hv(50g) | use of alloy |
|---|---|---|---|---|---|---|---|---|---|---|---|---|---|---|---|---|---|
| invention alloy | | | | | | | | | | | | | | | | | |
| 1 | 1 | 0.8 | 0.8 | 105 | — | 6 | — | 13 | 23 | 15 | — | — | bal | 18.8 | 28.2 | 161 | casting alloy |
| 2 | 1 | 0.8 | 0.8 | 3 | — | 7 | — | 13 | 23 | 15 | — | — | " | 16.9 | 24.9 | 170 | |
| 3 | 1 | 0.8 | 0.8 | 5.5 | — | 7 | — | 13 | 23 | 15 | — | — | " | 17.3 | 24.2 | 177 | |
| 4 | 1 | 0.8 | 0.8 | — | 3 | 7 | — | 13 | 23 | 15 | — | — | " | 16.8 | 25.2 | 175 | |
| 5 | 1 | 0.8 | 0.8 | 2 | 1.5 | 7 | — | 13 | 23 | 15 | — | — | " | 16.5 | 24.3 | 179 | |
| 6 | 1 | 0.8 | 0.8 | 3 | — | — | 8 | 13 | 23 | 15 | — | — | " | 17.1 | 25.9 | 192 | |
| 7 | 1 | 0.8 | 0.8 | 3 | — | — | 5 | 13 | 23 | 15 | — | — | " | 17.6 | 28.1 | 180 | |
| 8 | 1 | 0.8 | 0.8 | 3 | — | 6 | 2.5 | 13 | 23 | 15 | — | — | " | 16.2 | 24.0 | 174 | |
| 9 | 1 | 0.8 | 0.8 | — | 3 | 4 | 2.5 | 13 | 23 | 15 | — | — | " | 17.0 | 26.4 | 185 | |
| 10 | 1 | 0.8 | 0.8 | 3 | — | 1.5 | — | 13 | 23 | 15 | — | — | " | 18.4 | 30.4 | 151 | |
| 11 | 1 | 0.8 | 0.8 | 3 | — | 7 | — | 27 | 23 | 15 | — | — | " | 18.7 | 29.2 | 167 | |
| 12 | 1 | 0.8 | 0.8 | 3 | — | 7 | — | 13 | 13 | 15 | — | — | " | 19.3 | 28.6 | 164 | |
| 13 | 1 | 0.8 | 0.8 | 3 | — | 7 | — | 13 | 23 | 19 | — | — | " | 18.8 | 32.0 | 173 | |
| 14 | 1 | 0.8 | 0.8 | 3 | — | 7 | — | 13 | 23 | 15 | 0.7 | — | " | 15.1 | 22.7 | 171 | |
| 15 | 1 | 0.8 | 0.8 | 3 | — | 7 | — | 13 | 23 | 15 | 0.06 | — | " | 16.5 | 23.9 | 168 | |
| 16 | 1 | 0.8 | 0.8 | 3 | — | 7 | — | 13 | 23 | 15 | — | 0.005 | " | 16.3 | 24.5 | 168 | |
| 17 | 1 | 0.8 | 0.8 | — | 3 | — | 7 | 13 | 23 | 15 | — | 0.04 | " | 15.7 | 24.3 | 169 | |
| 18 | 1 | 0.8 | 0.8 | 3 | — | 4.5 | 2 | 13 | 23 | 15 | 0.4 | 0.003 | " | 15.4 | 24.0 | 172 | |
| 19 | 1.8 | 0.8 | 0.8 | 3 | — | 7 | — | 13 | 23 | 15 | — | — | " | 18.0 | 27.0 | 231 | |
| 20 | 0.5 | 0.8 | 0.8 | 3 | — | 7 | — | 13 | 23 | 15 | — | — | " | 17.3 | 25.1 | 152 | |
| 21 | 0.1 | 0.8 | 0.8 | 3 | — | 7 | — | 13 | 23 | 15 | 0.15 | 0.03 | " | 17.2 | 27.5 | 142 | forging alloy |
| 22 | 0.02 | 0.8 | 0.8 | 3 | — | 7 | — | 13 | 23 | 15 | 0.12 | 0.02 | " | 17.6 | 29.9 | 133 | |
| control alloy | | | | | | | | | | | | | | | | | |
| 1 | 1 | 0.8 | 0.8 | 0.2 | — | 7 | — | 13 | 23 | 15 | — | — | " | 39.7 | 61.9 | 146 | casting alloy |
| 2 | 1 | 0.8 | 0.8 | 3 | — | 0.1 | 0.2 | 13 | 23 | 15 | — | — | " | 31.5 | 59.4 | 136 | |
| 3 | 1 | 0.8 | 0.8 | 3 | — | 7 | — | 36 | 23 | 15 | — | — | " | 28.7 | 44.8 | 168 | |
| 4 | 1 | 0.8 | 0.8 | — | 3 | — | 5 | 13 | 7 | 15 | — | — | " | 32.4 | 55.1 | 140 | |
| 5 | 1 | 0.8 | 0.8 | 3 | — | 4 | 2.5 | 13 | 23 | 30 | — | — | " | 37.2 | 61.1 | 157 | |
| prior art alloy | | | | | | | | | | | | | | | | | |
| 1 | 0.4 | 0.8 | 0.8 | — | — | — | — | 14 | — | 23 | — | — | " | 94.2 | 286.9 | 127 | casting alloy |
| 2 | 1.2 | 1.5 | — | — | — | — | 5 | 1.5 | bal | 28 | — | — | 2 | 24.5 | — | 370 | |
| 3 | 0.05 | 0.2 | 0.4 | — | — | — | — | — | — | — | — | — | bal | 109.0 | 303.0 | — | forging alloy |
| 4 | 0.05 | 0.6 | — | — | — | — | 15 | 10 | bal | 20 | — | — | 3 | 31.2 | 129.1 | — | |

*Yearly av. depth of erosion in fluid molten Zn.

The alloy of which a structural member of the type contemplated by this invention (i.e. which is directly exposed to molten zinc) is to be made desirably has an erosion resistance such that the average depth of erosion is less than 20.0 mm/year when it is immersed in fluid molten zinc having a conventional operating temperature (450° to 470° C.). Therefore, the invention alloys 1 to 22 obviously have good erosion resistance that satisfies such requirement whether they are used as casting material or forging material.

The control alloys 1 to 5 and prior art alloys 1 to 4 have such erosion resistance that the average depth of erosion is greater than 20.0 mm/year. The following three control alloys have particularly low erosion resistance: control alloy 1 which contains little niobium and tantalum, control alloy 2 whose niobium and tantalum levels are within the range defined in this invention but which contains little molybdenum and tungsten, and control alloy 5 the niobium, tantalumn and molybdenum levels of which are within the ranges defined in this invention but which contains more chromium than defined in this invention. Prior art alloy 3 (low-carbon steel) and prior art alloy 1 (cast stainless steel HH) free from niobium, tantalum, molybdenum, tungsten and cobalt also have very low erosion resistance.

suitable hardness, not as hard as Stellite No. 6 and not as soft as cast stainless steel HH, and therefore, it can be cast, worked or build-up welded onto a structural member of support roll, sink roll and the like which, otherwise, is subjected to mechanical wear due to friction against a steel plate being galvanized. The alloy exhibits excellent performance and permits use over an extended period of time. In addition, the alloy can be manufactured at low cost because it has a relatively low content of expensive elements such as cobalt.

We claim:

1. An iron-base alloy having high erosion resistance to molten zinc attack which essentially consists of (by weight);

0.01 to 2% of carbon;

0.01 to 2% of silicon;

0.01 to 2% of manganese;

1.5 to 5.5% niobium and 0 to 3% tantallum, wherein the total of niobium and tantallum is 1.5 to 6%;

totally 5.5 to 10% of at least one element selected from the group consisting of molybdenum and tungsten, but molybdenum content is at lesast 5.5%;

10 to 30% of nickel;

10 to 30% of cobalt;

10 to 25% of chromium; and a balance which is iron and inevitable impurities.

2. An iron-base alloy according to claim 1 which further contains at leats one element selected from the group consisting of 0.001 to 2% zirconium and 0.001 to 2% of boron.

3. An iron-base alloy according to claim 1 or claim 2 which contains 10 to 15% of nickel, 15 to 30% of cobalt, and 10–18% of chromium.

4. An iron-base alloy according to claim 1 which contains 0 to 1.5% tantallum.

* * * * *